United States Patent [19]

Trützschler

[11] 4,198,725

[45] Apr. 22, 1980

[54] CLEANING AND DUST REMOVAL MACHINE

[75] Inventor: Hermann Trützschler, Mönchen-Gladbach, Fed. Rep. of Germany

[73] Assignee: Trützschler GmbH & Co. KG, Monchen-Gladbach, Fed. Rep. of Germany

[21] Appl. No.: 862,043

[22] Filed: Dec. 19, 1977

[30] Foreign Application Priority Data

Dec. 18, 1976 [DE] Fed. Rep. of Germany ..... 2657565

[51] Int. Cl.[2] ..... B08B 5/02; B08B 5/04

[52] U.S. Cl. ..... 15/306 B; 15/316 R; 15/345

[58] Field of Search ..... 15/306 R, 306 A, 306 B, 15/345, 346, 404, 316 R

[56] References Cited

U.S. PATENT DOCUMENTS

| | | | |
|---|---|---|---|
| 2,115,107 | 4/1938 | Hoffeld | 15/306 B X |
| 2,935,034 | 5/1960 | Jacobs | 15/306 B X |
| 2,999,262 | 9/1961 | Jenkins et al. | 15/345 X |
| 3,421,211 | 1/1969 | Eaves et al. | 15/306 B X |
| 3,571,840 | 3/1971 | Gleaton et al. | 15/404 X |
| 3,909,873 | 10/1975 | Minasov et al. | 15/306 B |

FOREIGN PATENT DOCUMENTS

| | | | |
|---|---|---|---|
| 994498 | 8/1951 | France | 15/306 B |
| 207717 | 6/1968 | U.S.S.R. | 15/306 B |

*Primary Examiner*—Christopher K. Moore
*Attorney, Agent, or Firm*—Spencer & Kaye

[57] ABSTRACT

Apparatus for cleaning textile fiber tufts, composed of an endless, continuously rotating, air-permeable conveyor belt provided with openings whose width is less than the size of the tufts, a device for continuously supplying textile fiber tufts to the upper side of the conveyor belt, a device for sucking air away from the belt, a device disposed for emitting surges of compressed air in the direction toward the conveyor belt and located at the side of the conveyor belt facing away from the side to which the tufts are supplied, and a perforated cover plate disposed to the side of the conveyor belt to which the tufts are supplied and located at a distance from the conveyor belt, with the device for sucking air away being connected to the perforated cover plate.

8 Claims, 2 Drawing Figures

CLEANING AND DUST REMOVAL MACHINE

BACKGROUND OF THE INVENTION

The present invention relates to an apparatus for cleaning textile fiber tufts, or flakes, the apparatus being of the type which includes an endless, continuously rotating, air-permeable conveyor belt, a device for continuously delivering textile fiber tufts, or flakes, to the upper side of the conveyor belt, and a device for sucking air away from the belt. Such apparatus can be employed in connection with opening or picking of the textile material.

In a known system of this type, a device for sucking off air from the bottom through the conveyor belt carrying the fiber flakes is disposed to the side of the conveyor belt facing away from the flakes. One drawback of this apparatus is that the flakes are pulled tightly onto and against the conveyor belt and the dust constituent must be sucked through the resulting layer of fleece or lap. A mechanical device is required to remove the fleece from the belt, which causes shortening and matting of the staple fibers.

SUMMARY OF THE INVENTION

It is an object of the present invention to enable a greater amount of dust to be removed during the cleaning of textile fiber tufts while subjecting the fiber material to a gentle treatment.

These and other objects are achieved, in apparatus for cleaning textile fiber tufts, and including an endless, continuously advancing, air-permeable conveyor belt, means for continuously supplying textile fiber flakes to the upper side of the conveyor belt, and means for sucking air away from the belt, by providing the conveyor belt with openings whose width is less than the size of the tufts, by the inclusion of air dispensing means disposed for emitting surges of compressed air in the direction toward the conveyor belt and located at the side of the conveyor belt facing away from the side to which the tufts are supplied, and a perforated cover plate disposed to the side of the conveyor belt to which the tufts are supplied and located at a distance from the conveyor belt, and by connecting the means for sucking air away to the perforated cover plate.

The "size" of each tuft is generally its smallest transverse dimension. Of course, the tufts supplied to the conveyor belt will vary in size over a certain range and the width of the openings should be smaller than the lower end of that range.

Due to the fact that the openings in the conveyor belt are smaller in width than the size of the flakes, heavy waste, for example seeds and pieces of shell, can fall through the openings into a waste collecting area.

The device for emitting surges of air whirls the fiber material being advanced on the conveyor belt in an upward direction. This blows the tufts upward and the heavy components are the first to drop down again and these pass out of the apparatus through the openings in the conveyor belt. The fiber material also comes to lie on the conveyor belt, but at a somewhat later time. The dust released during the upward whirling floats in the space above the conveyor belt and is sucked away through the perforated cover plate by a continuous stream of suction air. In this way it is possible to substantially improve the degree of dust removal. The advantage is that the fiber material is treated with particular care so that for example, shortening of the staple fibers and matting is prevented.

According to a preferred embodiment of the invention, the openings in the conveyor belt are in the form of narrow longitudinal slits. Advantageously this is achieved by constituting the conveyor belt of a plurality of V belts, flat belts, round belts, wires or ropes which are spaced apart to define the slits and which are in form-locking engagement with drive rollers to produce a stable run of the conveyor belt.

In a structurally particularly simple embodiment, the apparatus for emitting surges of air is composed of parallel pipes extending perpendicularly to the conveyor belt transporting direction, the pipes preferably being provided with a plurality of juxtaposed nozzles at the side facing the conveyor belt.

According to a further preferred embodiment, the pipes are connected to a compressed air generator, e.g. a pressure ventilator or a pressure tank, producing periodic pressure surges. This permits the tufts to be blown upward in batches, which causes foreign elements such as waste and dust to be released.

The cover plate delineates, on the one hand, the effective area of the conveyor belt and, on the other hand, the area for the removal of the dust. Advisably the removal area is connected to a suction air regulator in addition to the device for sucking out the air. The suction intensity can thus be infinitely varied by adjusting the amount of air flowing to the frontal face of the removal area.

If a vibrating metal sheet is placed between the upper and lower reaches of the conveyor belt, the heavy waste falling through the slits in the upper reach can be caught and discharged laterally via that sheet.

DESCRIPTION OF THE PREFERRED EMBODIMENTS

Figure 1:
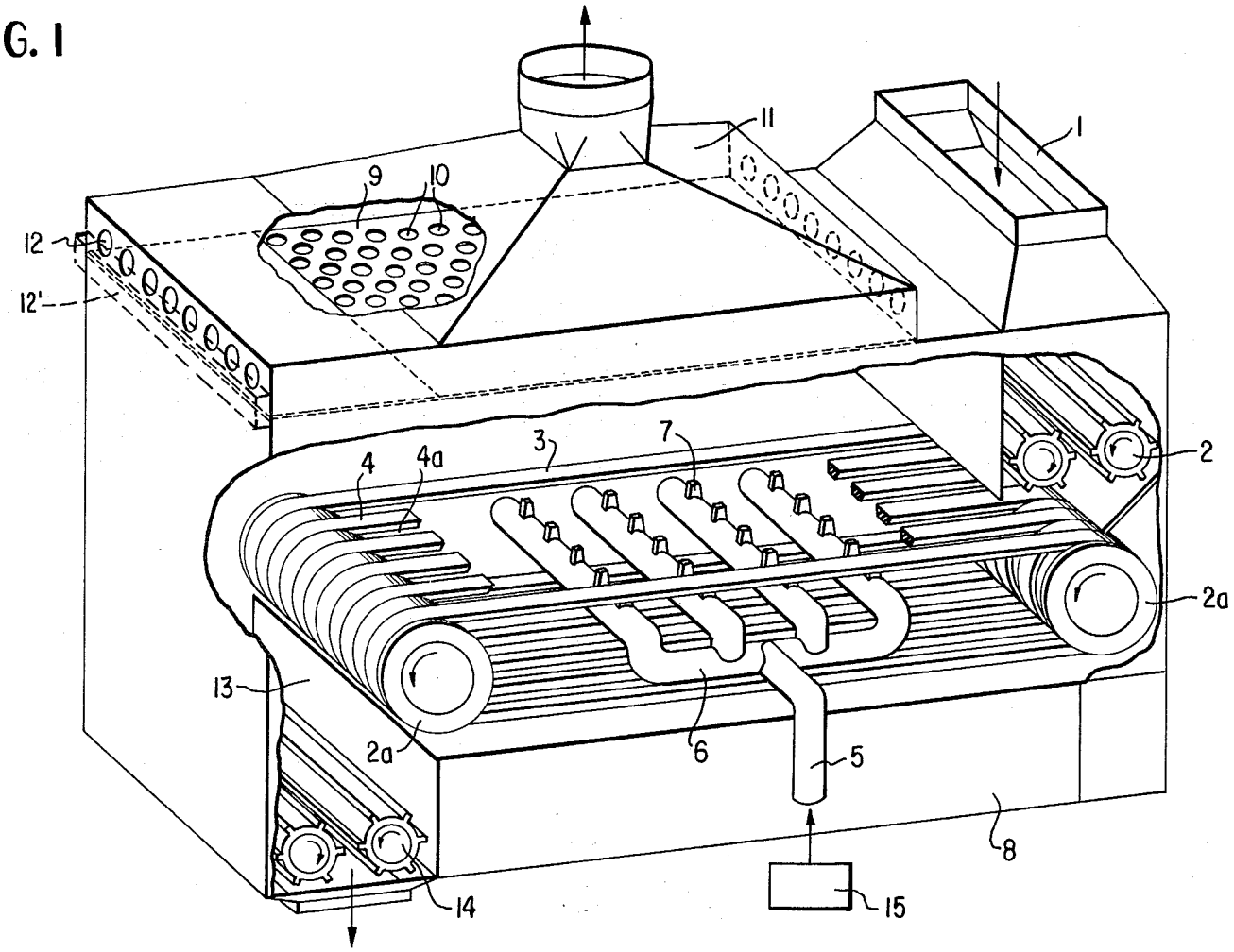
FIG. 1 is a partly broken-away perspective view of a preferred embodiment of the invention.

FIG. 1 shows an apparatus which includes a shaft 1 through which fiber material is introduced in order to be supplied to a conveyor belt 3 via two delivery rollers 2 which rotate in the directions indicated by their associated arrows. The conveyor belt 3 is driven by two drive rollers **2*a* and is composed of a plurality of parallel V belts 4. The spacing between the V belts 4** is dimensioned so that no fibers can fall through but heavy waste can. The spacing is, for example 8 mm.

In the area between the upper and lower reaches of the conveyor belt 3, a plurality of parallel pipes 6 are arranged one behind the other in the conveyor conveying direction and are connected to a common branch line 5. At the side facing the upper reach of belt 3, each pipe 6 is provided with a plurality of nozzles 7, spaced along the length of its respective pipe and pointing toward the upper reach of belt 3.

Branch line 5 is connected to a compressed air generator 15 which generates periodic surges of pressurized air, for example at a rate of 2 pressure surges per second, that flow into pipes 6 and through nozzles 7. This causes the fibers being conveyed on belt 3 to be blown up and out, in the direction of a perforated cover plate 9 which is located at a distance above conveyor belt 3. While the heavier waste drops down through the longitudinal slits 4a between adjacent V belts 4 into the waste area 8, dust is extracted by a suction ventilator (not shown) through openings 10 in the perforated cover plate 9 and into the removal area of the device 11, where the air is sucked out, and from there the dust is removed through a discharge line (not shown).

The removal area 11 is connected to a suction air regulator 12. The tufts which have thus been cleaned move from the discharge side of conveyor belt 3 into a delivery shaft 13, from where they are removed by means of removal rollers 14. Regulator 12 has a plurality of openings which can be partially blocked by a movable plate 12' to varying degrees in order to regulate the suction force.

Figure 2:
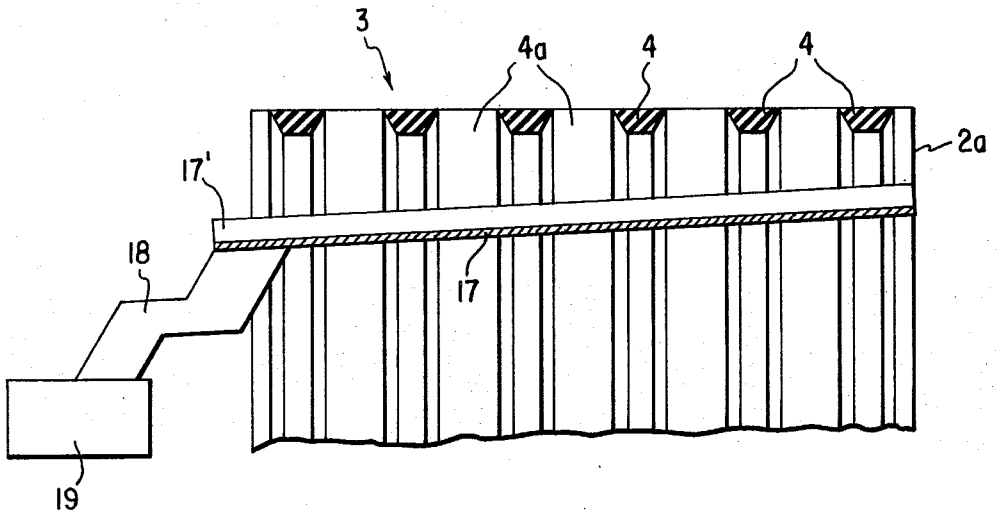
FIG. 2 is an elevational detail view taken in the conveyor belt conveying direction and illustrating a modified embodiment of the invention.

In the embodiment shown in FIG. 2, a metal sheet 17 is disposed between the upper and lower reaches of belt 3, only the upper reach being shown, and is connected to a vibratory exciter 19 via vibration-transmitting supports 18. The plate 17 is inclined slightly to the horizontal to facilitate discharge of heavy wastes laterally of the conveyor belt conveying direction. The plate 17 is disposed beneath pipes 6 (not shown in FIG. 2). The sides of plate 17 adjacent each of rollers 2a can be provided with lips 17' to assure that all waste particles dropping onto the plate will be laterally discharged.

It will be understood that the above description of the present invention is susceptible to various modifications, changes and adaptations, and the same are intended to be comprehended within the meaning and range of equivalents of the appended claims.

What is claimed is:

1. In apparatus for cleaning textile fiber tufts, said apparatus including an endless, continuously advancing, air-permeable conveyor belt, means for continuously supplying textile fiber tufts to the upper side of the conveyor belt, and means for sucking air and dust away from the belt, the improvement wherein:

said conveyor belt is provided with openings whose width is less than the size of the tufts; and said apparatus further comprises means disposed for emitting surges of compressed air in the direction toward said conveyor belt and located at the side of said conveyor belt facing away from the side to which the tufts are supplied, a perforated cover plate disposed on the side of said conveyor belt to which the tufts are supplied and located at a distance from said conveyor belt, said means for sucking air and dust away from said belt being connected to said perforated cover plate for pulling air and dust through said plate, and a vibrating metal sheet located between the upper and lower reaches of said conveyor belt for receiving and conveying away heavy waste which has dropped through the openings in the upper reach of said belt.

2. A textile fiber tuft cleaning device for removing dust and heavy waste particles from textile fiber tufts, comprising:

a conveyor belt having a supporting surface provided with openings each having a width which is less than the size of said tufts and large enough to permit said heavy waste particles to pass therethrough;

means for supplying textile fiber tufts to the upper surface of said conveyor belt;

air dispensing means disposed only below said conveyor belt for directing surges of compressed air upward toward said belt and through the openings therein thereby blowing said tufts upwardly from said conveyor belt to permit dust to be liberated from the tufts and said heavy waste particles to drop through the openings in said conveyor belt, the space above said conveyor belt being free of air dispensing means;

a perforated cover plate located above said conveyor belt; and means connected to said cover plate for sucking air and dust away from said conveyor belt and through said cover plate.

3. An arrangement as defined in claim 2 wherein the openings in said conveyor belt are in the form of narrow longitudinal slits.

4. An arrangement as defined in claim 3 wherein said conveyor belt comprises a plurality of parallel, movable elements.

5. An arrangement as defined in claim 2 wherein said means for emitting compressed air surges comprises a plurality of parallel pipes which extend perpendicular to the conveying direction of said conveyor belt.

6. An arrangement as defined in claim 5 wherein said pipes are provided at their side facng said conveyor belt with a plurality of juxtaposed nozzles spaced along the length of each said pipe.

7. An arrangement as defined in claim 6 wherein said means for emitting compressed air surges comprises a compressed air generator connected for supplying to said pipes periodic pressure surges of compressed air.

8. An arrangement as defined in claim 2 further comprising a suction air regulator connected to said means for sucking air away from said belt for regulating the sucton force produced by said means for sucking air away from said belt.

* * * * *